US005592056A

United States Patent [19]

Peyre et al.

[11] Patent Number: 5,592,056

[45] Date of Patent: Jan. 7, 1997

[54] ELECTRICAL PROTECTION OF AN ANODE OF A FLAT DISPLAY SCREEN

[75] Inventors: Jean-Francois Peyre, Rousset; Francis Courreges, Trets, both of France

[73] Assignee: Pixtech S.A., Rousset, France

[21] Appl. No.: 534,707

[22] Filed: Sep. 27, 1995

[30] Foreign Application Priority Data

Sep. 28, 1994 [FR] France ..... 94 11806

[51] Int. Cl.[6] ..... G09G 3/10

[52] U.S. Cl. ..... 315/169.1; 315/58; 315/169.3; 313/336; 313/496; 313/525

[58] Field of Search ..... 315/58, 169.1, 315/169.3, 169.4; 313/309, 336, 351, 496, 500, 525, 527

[56] References Cited

U.S. PATENT DOCUMENTS 4,940,916 7/1990 Borel et al. ..... 313/306
5,225,820 7/1993 Clerc ..... 340/752
5,231,387 7/1993 Clerc ..... 340/781
5,283,500 2/1994 Kochanski ..... 315/58
5,491,376 2/1996 Levine et al. ..... 313/495
5,525,857 6/1996 Gnade et al. ..... 313/309
5,528,102 6/1996 Gnade et al. ..... 313/496
5,534,744 7/1996 Leroux et al. ..... 313/309
5,536,993 7/1996 Taylor et al. ..... 315/169.3 X

*Primary Examiner*—Robert Pascal
*Assistant Examiner*—Haissa Philogene
*Attorney, Agent, or Firm*—Plevy & Associates

[57] ABSTRACT

An anode for flat display screens, of the type including at least one set of phosphor strips disposed over corresponding conductive strips and at least one interconnection conductor for the phosphor strips. Each conductive strip of each set is connected through a resistor to the associated interconnection conductor.

10 Claims, 4 Drawing Sheets

Fig 4A
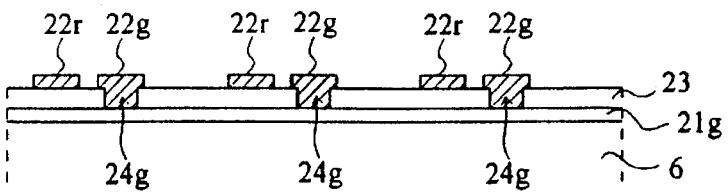
Fig 4B
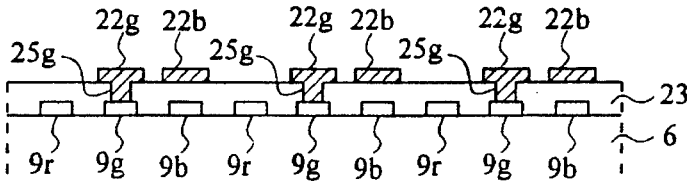
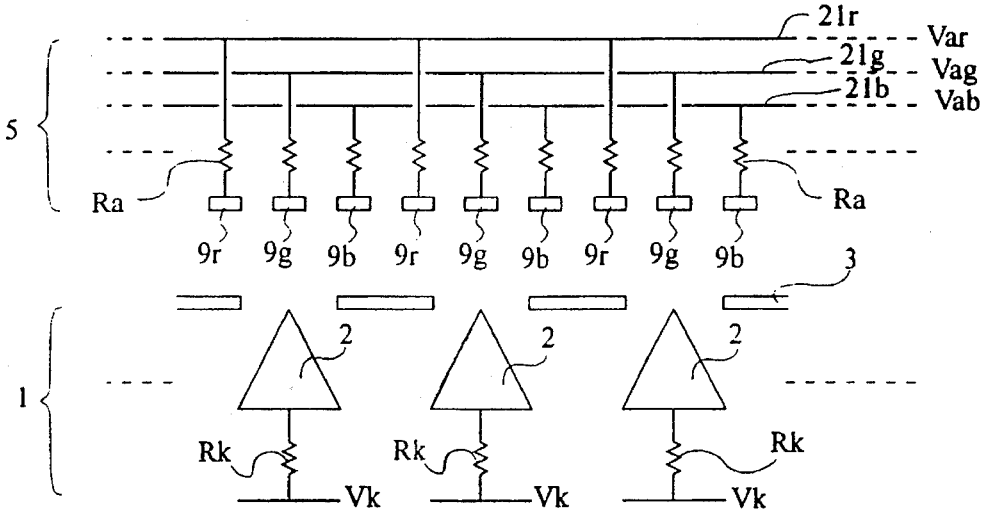
Fig 5
Fig 6
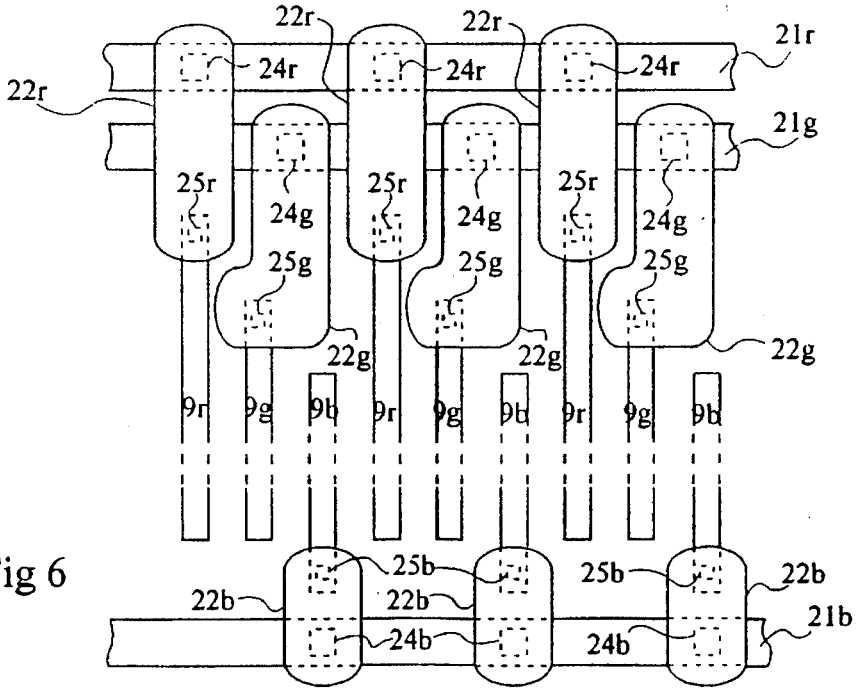

ELECTRICAL PROTECTION OF AN ANODE OF A FLAT DISPLAY SCREEN

BACKGROUND OF THE INVENTION

1. Field of the Invention

The present invention relates to the anode plate of a flat display screen. It more particularly relates to the realization of connections of phosphor elements of an anode for color screens, such as color screens including microtips.

2. Discussion of the Related Art

FIG. 1 represents a portion of a flat display screen with microtips of the type to which the invention applies.

Such microtip screens are mainly constituted by a cathode plate 1 including microtips 2 and by a gate 3 provided with holes 4 corresponding to the positions of the microtips 2. Cathode 1 is disposed so as to face a cathodo-luminescent anode 5, formed on a glass substrate 6 that constitutes the screen surface.

The operation and a detailed structure of such microtip screens are described in U.S. Pat. No. 4,940,916 assigned to Commissariat à l'Energie Atomique.

The cathode 1 is arranged in columns and is constituted, onto a glass substrate 10, of cathode conductors arranged in meshes from a conductive layer. The microtips 2 are disposed onto a resistive layer 11 that is deposited onto the cathode conductors and are disposed inside meshes defined by the cathode conductors. FIG. 1 partially represents the inside of a mesh, without the cathode conductors. The cathode 1 is associated with the gate 3 which is arranged in rows. The intersection of a row of gate 3 with a column of cathode 1 defines a pixel.

This device uses the electric field generated between the cathode 1 and gate 3 so that electrons are extracted from microtips 2 toward phosphors 7 of anode 5. In the case of a color screen, the anode 5 is provided with alternate phosphor strips 7*r*, 7*g*, 7*b*, each corresponding to a color (red, green, blue). The strips are separated one from the other by an insulating materiel 8. The phosphors 7 are deposited onto electrodes 9, which are constituted by corresponding strips of a transparent conductive layer such as indium-tin oxide (ITO). Each group of red, green, blue strips is alternatively biased with respect to cathode 1 so that the electrons extracted from the microtips 2 of one pixel of the cathode/gate are alternatively directed toward the facing phosphor elements 7 of each color.

The selection of the phosphor element 7 (the phosphor element 7*g* in FIG. 1) that should be bombarded by electrons from the microtips 2 of cathode 1 requires to selectively control the biasing of the phosphor elements 7 of anode 5, for each color.

FIG. 2 schematically illustrates an anode structure for a conventional color screen. FIG. 2 is a partial view of an anode 5 fabricated according to known techniques. The strips 9 of the anode electrodes, corresponding to phosphor elements 7 of a same color deposited on the substrate 6, are interconnected outside the useful surface of the screen to be connected to a control system (not shown). Two interconnection tracks 12 and 13, respectively corresponding to anode electrodes 9*g* and 9*b*, are realized for two of the three colors of the phosphors (for example 7*g* and 7*b*). An insulation layer 14 (represented in dot-and-dash lines in FIG. 2) is deposited over the interconnection track 13. A third interconnection track 15 is connected, through conductors 16 deposited over the insulation layer 14, to the anode electrode strips 9*r* designed for the phosphors 7*r* of the third color.

Generally, the rows of gate 3 are sequentially biased to a voltage of approximately 80 volts whereas the phosphor strips (for example 7*g* in FIG. 1) to be excited are biased at a voltage of approximately 400 volts, the remaining strips (for example 7*r* and 7*b* in FIG. 1) being at a zero voltage. The columns of cathode 1, whose voltage represents for each row of the gate 5 the brightness of the pixel defined by the intersection of the column of the cathode and of the row of gate 5 in the considered color, are set to respective voltages between a maximum emission voltage and a non-emission voltage (for example 0 and 30 volts, respectively).

The selection of the bias voltages is associated with the characteristics of the phosphors 7 and microtips 2.

Conventionally, below a 50-V voltage difference between the cathode and the gate, no electron emission occurs and the maximum emission corresponds to a 80-V voltage difference.

The voltage difference between the anode and the cathode is associated with the distance between the electrodes. A maximum voltage difference is desired for the screen brightness, which involves that the distance separating the electrodes should be as large as possible. However, the structure of the inter-electrodes gap, which includes spacers that may generate shadow areas in the screen if they are oversized, prevents this gap between the electrodes from being increased. Therefore, the distance separating the electrodes of a conventional screen is approximately 0.2 mm. This requires the selection of an anode/cathode voltage that is critical because of the possible formation of electric arcs. Destructive electric arcs can occur due to a possible irregularity of the distance separating each microtip or the gate layer from the phosphor elements of the anode. Furthermore, such irregularities are unavoidable by virtue of the small size and of the manufacturing process of the anode and of the cathode-gate.

On the cathode side, the resistive layer 11 makes it possible to limit the formation of destructive short-circuits between the microtips and the gate.

However, on the anode side, electric arcs may occur between the gate 3 and some of the phosphor elements 7 of the anode that are biased to draw the electrons from the microtips 2 (for example, the phosphor elements 7*g* in FIG. 1). Electric arcs can also occur between two adjacent phosphor strips (for example 7*g* and 7*r* in FIG. 1) because of the voltage difference between these two strips.

SUMMARY OF THE INVENTION

An object of the invention is to avoid the above drawbacks by providing an anode for a flat display screen including microtips which eliminates the possibility for electric arcs to occur between the anode and gate or between two adjacent phosphor strips of the anode, without impairing the brightness of the screen.

To achieve this object, the present invention provides an anode for a flat display screen, of the type including at least one set of phosphor strips disposed over corresponding conductive strips and at least one interconnection conductor for the strips of the set of phosphor elements. The conductive strips of the set are interconnected through resistors disposed in series between the conductive strips and the interconnection conductor with which they are associated.

According to an embodiment of the invention, each conductive layer is individually connected to the interconnection conductor through a resistor.

According to another embodiment of the invention, a single resistor is associated with a plurality of conductive strips of the set.

According to another embodiment of the invention, the resistors are serigraphied thick-films resistive portions over an insulation layer deposited at least over one track constituting the h interconnection conductor, the insulation layer being locally etched away in front of the extremities of each resistive portion to allow the electrical connection of these extremities, respectively to an extremity of at least one conductive strip and to the interconnection track.

According to another embodiment of the invention, the insulation layer extends over the whole surface of the anode and is etched away, in the useful surface of the screen, in front of each conductive strip.

According to another embodiment of the invention, all the resistive portions associated with the interconnection track have the same length.

According to another embodiment of the invention, the anode includes three sets of alternate strips of phosphor elements, each corresponding to a color, and at least three conductors interconnecting the strips of a same color.

According to another embodiment of the invention, all the resistive portions associated with a same interconnection track have the same length and extend from an extremity of a conductive strip to the interconnection track with which this strip is associated.

According to another embodiment of the invention, all the interconnection tracks are parallel and on the same side of the anode, perpendicularly to the conductive strips.

According to another embodiment of the invention, at least two interconnection tracks, perpendicular to the conductive strips, surround these conductive strips.

The foregoing and other objects, features, aspects and advantages of the invention will become apparent from the following detailed description of the present invention when taken in conjunction with the accompanying drawings.

BRIEF DESCRIPTION OF DRAWINGS

FIGS. 4A–4B are cross-sectional views along lines A—A' and B—B', respectively, of FIG. 3;

FIG. 5 represents an equivalent circuit of a microtip screen with an anode according to the embodiment of FIG. 3;

FIG. 6 represents a variant of the embodiment of FIG. 3;

For the sake of clarity, the various drawings are not drawn to scale and same elements are designated in the various figures with the same references.

DETAILED DESCRIPTION

Figure 1:
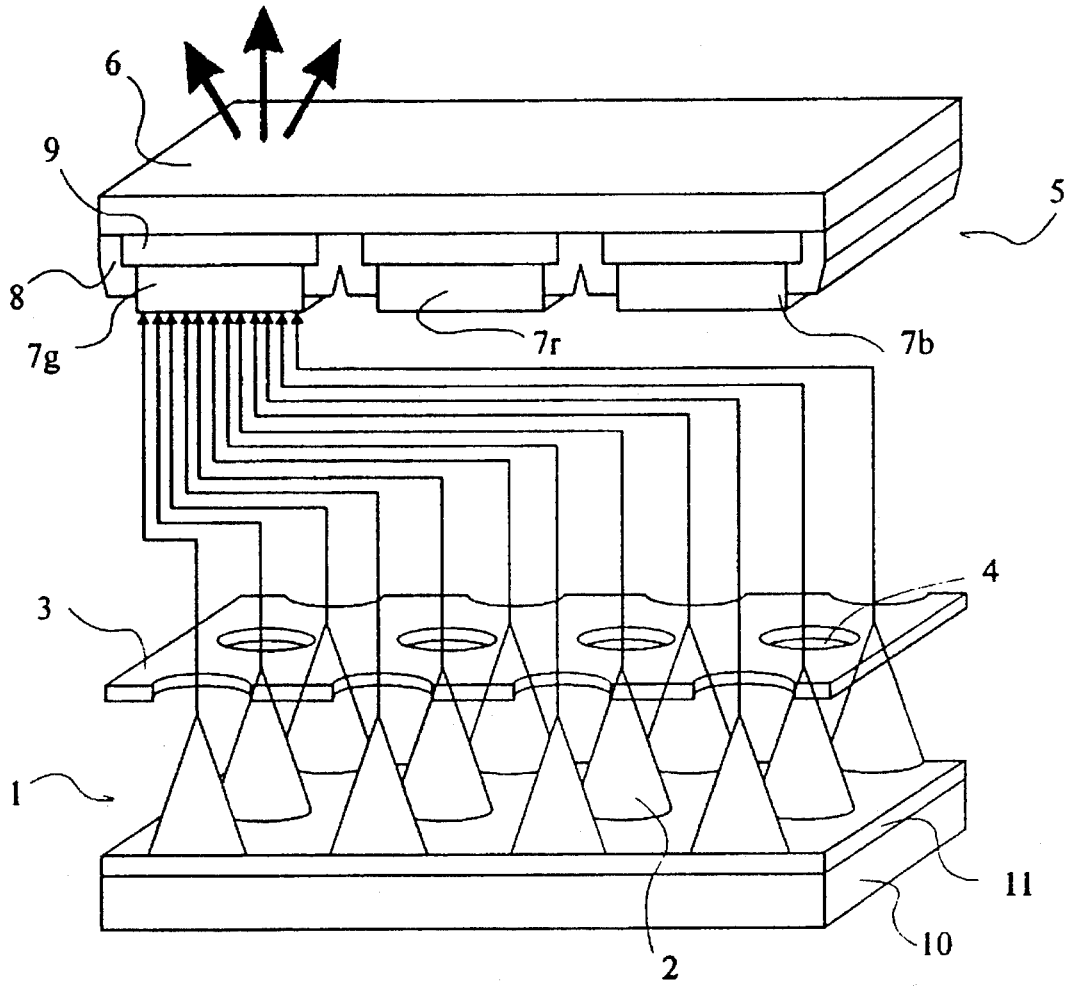
PRIOR ART Fig 1
FIGS. 1 and 2, above described, explain the state of the art and the problem encountered.
Figure 2:
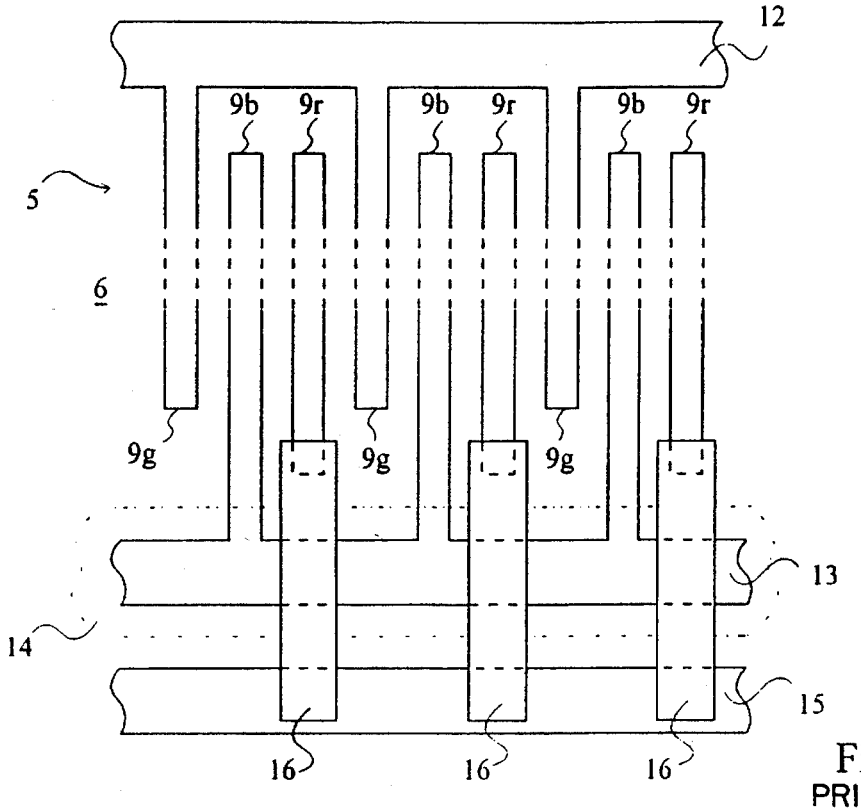
Fig 2 PRIOR ART

A main feature of the invention is to realize the interconnections of the anode conductive strips biasing the phosphor elements, through resistors disposed in series between the conductive strips and the interconnection track with which they are associated.

The present invention biases each phosphor strip, or a small group of phosphor strips of a same color, through a resistor disposed in series between this strip, or this small group, and the interconnection track with which it is associated.

Providing a plurality of resistors for each interconnection track prevents the anode-cathode voltage from dropping by more than a small percentage while disposing resistors having sufficient values to limit the current flowing in the conductive strips.

Indeed, all the strips of a same color are simultaneously biased. This requires a sufficient current to flow in an interconnection track of strips of the same color so that this current can be distributed over all the strips (several hundred). In contrast, because of the addressing executed by the control electronic system for displaying an image, one pixel per anode row is emitting at a predetermined time. In other words, since the gate is biased according to a line scanning, and since the intersection of a gate row with a cathode column defines a pixel, only the microtips of one pixel bombard the phosphor elements of an anode strip at a predetermined time.

Therefore, resistors having sufficiently high values can be provided to generate in the "anode current/cathode voltage" and "anode current/voltage between two adjacent conductive strips of an anode" characteristics, a load line providing a limitation of the occurrence of electric arcs. The value of the resistors is preferably selected to not cause a decrease in the voltage of the anode by more than a small percentage in order to not cause a modification of the brightness of the screen that might be visible for the viewer, and further to not cause a significant parasitic power dissipation.

Several techniques can be used, according to the present invention, for the implementation of these series resistors.

It is possible, for example, to use an array of discrete components, incorporated in a printed circuit that is connected through an array of conductors to the conductive strips of the screen. However, such an implementation is not a preferred embodiment of the invention because it leads to multiplying the connections of the screen with the electronic control system and to increasing the size of this control system.

It is also possible to implement these resistors according to the thin-film technique by depositing such films over or below the conductive strips. These films can, for example, be made of doped, amorphous or polycrystalline silicon or nickel-chromium.

It is further possible to realize these resistors by means of a contact resistance system provided within the thickness, between the extremities of the conductive strips and the interconnection tracks.

In a preferred embodiment of the invention, these resistors are fabricated according to a thick-film technique, for example by depositing through serigraphy an ink or a resistive paste such as those used for hybrid circuits.

Thus, according to the invention all the conductive strips of the anode are electrically insulated one from the other and also from the interconnection tracks, then a resistive layer is deposited between each conductive strip, or a group of a few strips, and the interconnection track.

Figure 3:
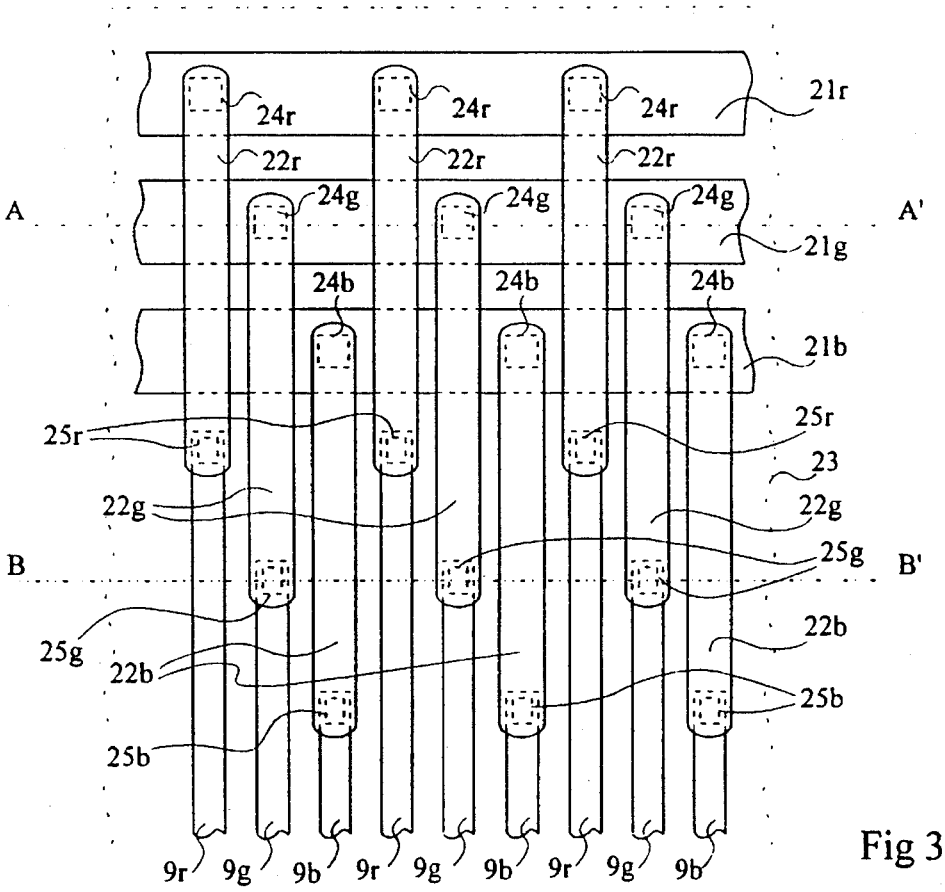
FIG. 3 represents a first embodiment of an anode of a microtip screen according to the invention.

As shown in FIGS. 3, 4A and 4B, an anode according to a first embodiment of the invention is formed by parallel conductive strips 9*r*, 9*g*, 9*b* that are disposed over a substrate 6 and designed to accommodate phosphor elements (not shown) in the useful surface of the screen. In the case of a color screen such as represented in FIG. 3, these strips should be sequentially biased by groups of strips of the same color (red, green, blue).

Each strip 9*r*, 9*b*, 9*g* is individually connected to a track 21*r*, 21*g*, 21*b*, respectively, interconnecting strips of the same color, through a resistive portion 22. The resistive portions (for example 22*r*) associated with an interconnection track (for example 21*r*) are electrically isolated from the two other interconnection tracks (for example 21*g*, 21*b*). For this purpose, an insulation layer 23 is interposed at least over the two interconnection tracks 21*g* and 21*b* that are the nearest to the extremities of the conductive strips 9.

Preferably, as represented, the insulation layer 23 covers the whole anode and is partially etched away in front of the two extremities of each resistive portion 22, to allow the electrical connection of these extremities to an extremity of a conductive strip 9 and to an interconnection track 21, respectively. The insulation layer 23 covers the whole anode, and is also conventionally etched away in the useful surface of the screen in front of each conductive strip 9 to receive the phosphor elements. In other words, in this instance, the insulation layer 8 (FIG. 1) between the phosphor elements is a part of the insulation layer 23.

Apertures 24*r*, 24*g*, 24*b* and 25*r*, 25*g*, 25*b* are formed in the insulation layer 23 under the extremities of the resistive portions 22*r*, 22*g*, 22*b*, respectively, in front of an interconnection track 21*r*, 21*g*, 21*b* and in front of the extremity of a conductive strip 9*r*, 9*g*, 9*b*.

Thus, the electrical connection between each interconnection track 21 and a phosphor strip 9 is made through a series resistor constituted by a resistive portion 22.

In order to not impair the regularity of the brightness of the screen, the size of the resistive portions 22 is designed so that all the resistive portions have the same resistance between their extremities, at least for all the resistive portions associated with a same interconnection track, i.e. a same color. In other words, all the resistive portions associated with a same interconnection track have the same length and the same section, which fixes the value of the series resistor between a conductive strip and the associated interconnection track. Preferably, all the resistive portions 22 of the screen have the same section and the same length.

The electrical interconnection of the conductive strips 9 is illustrated in FIG. 5 which represents an equivalent circuit of the embodiment of FIG. 3.

Each conductive strip 9 is individually protected against electric arcs through a high value series resistor Ra between this strip and the associated interconnection track 21. The value of resistor Ra is selected so as to limit the current in the conductive strip 9 to a selected predetermined value to prevent the occurrence of destructive electric arcs, without causing a significant anode voltage drop.

FIG. 5 shows one microtip 2 per pixel, whereas, in practice, there are several thousand of microtips per pixel. Thus, there is a resistor Rk which corresponds to the resistive layer 11 between the cathode conductors and the microtips. The resistor Rk allows the homogenization of the electron emission of microtips 2 and prevents short-circuits from occurring between the gate 3 and the microtips 2. The resistor Ra formed by a predetermined resistive portion is electrically connected in series with the global resistor Rk of a pixel. The net value of resistor Rk corresponding to one pixel is about 2 MΩ and is in series with the value of resistor Ra which has the same order of magnitude (approximately 0.7 MΩ). Thus, the addition of such resistive portions does not impair the electron emission of microtips of a predetermined pixel.

By way of example, to obtain a current of 15 mA per pixel, which is a typical value, and for a 500-V biasing voltage Va of the anode strips and a biasing voltage Vk of the cathode columns ranging from 0 to 30 V, a resistance of approximately 670 kΩ limits the voltage drop across the resistor to approximately 2%. Such a resistor value prevents destructive electric arcs from occurring by clipping the current in the conductive strip to 0.7 mA, while making the decrease in the brightness of the screen invisible.

Furthermore, it can be noticed that the addition of resistors Ra does not impair the switching speed of the anode lines. Indeed, although the value of resistor Ra intervenes on the time constant of the cell RC that is formed by the association of resistor Ra with the intrinsic capacitance and resistance of the conductive strip, the time constant so obtained remains quite tolerable. By way of example, for the pixel disposed the further away from the interconnection track, the capacitance of an ITO anode conductive strip is approximately 30 pF for 30 cm in length, and its intrinsic resistance is approximately 20 kΩ. The time constant introduced by the addition of a resistor Ra is 20 μs, which is quite tolerable. In fact, since each anode strip remains biased throughout the line scanning of the gate, the switching of the anode rows conventionally occurs, for a color screen, only 3 to 6 times per image depending upon the addressing arrangement.

The current limitation, individually for each conductive strip of the anode, also prevents destructive electric arcs from occurring between two adjacent strips.

Resistors Ra having a value of approximately 670 kΩ can be made according to a thick-film technique with an ink having a 50 kΩ/square layer resistance, by means of resistive portions 22 having a width of approximately 75 μm and a 1-mm length.

FIG. 6 illustrates a variant of the embodiment of FIG. 3. According to this alternative embodiment, all the interconnection tracks are not on the same side of the anode. Two tracks (for example 21*r* and 21*g*) are on the same side of the anode, whereas the third track (for example 21*b*) is disposed in parallel with the tracks 21*r* and 21*g*, but at the other side of the conductive strips 9. Such an alternative embodiment requires a lower precision for the serigraphy of the thick film resistive portions 22.

Figure 7:
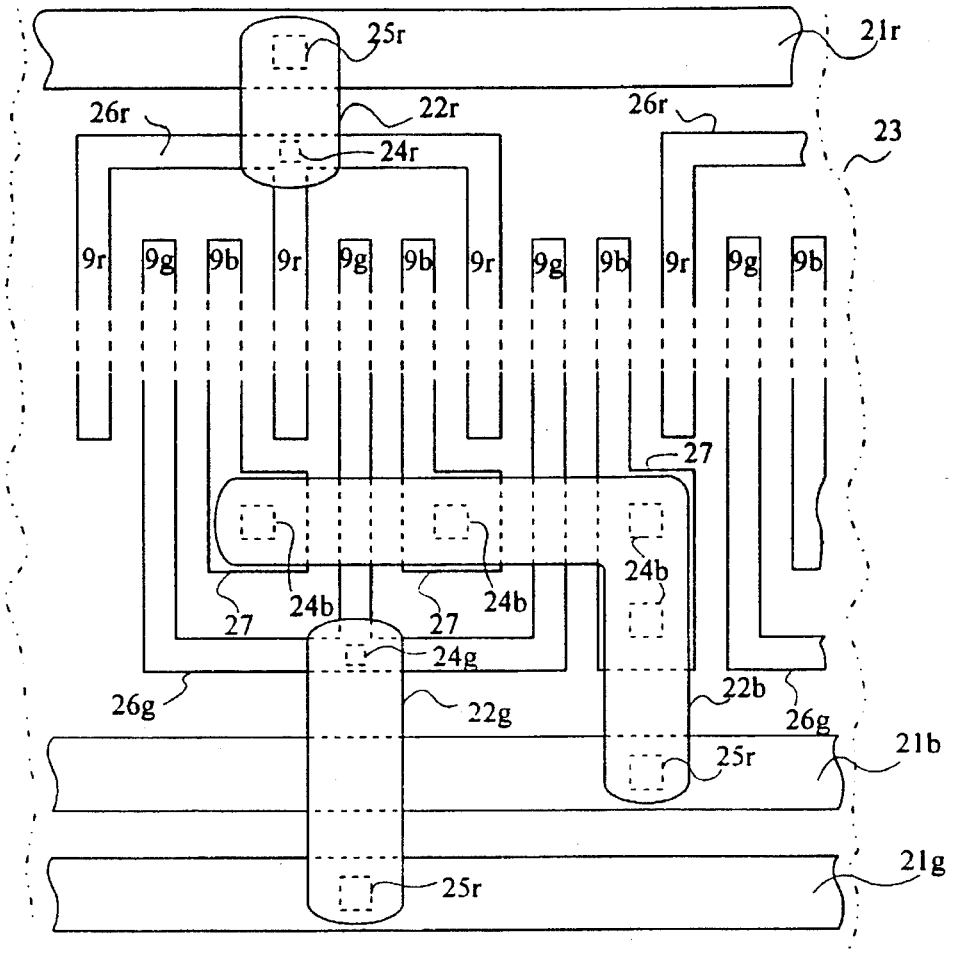
FIG. 7 represents a second embodiment of an anode of a microtip screen according to the invention.
Figure 8:
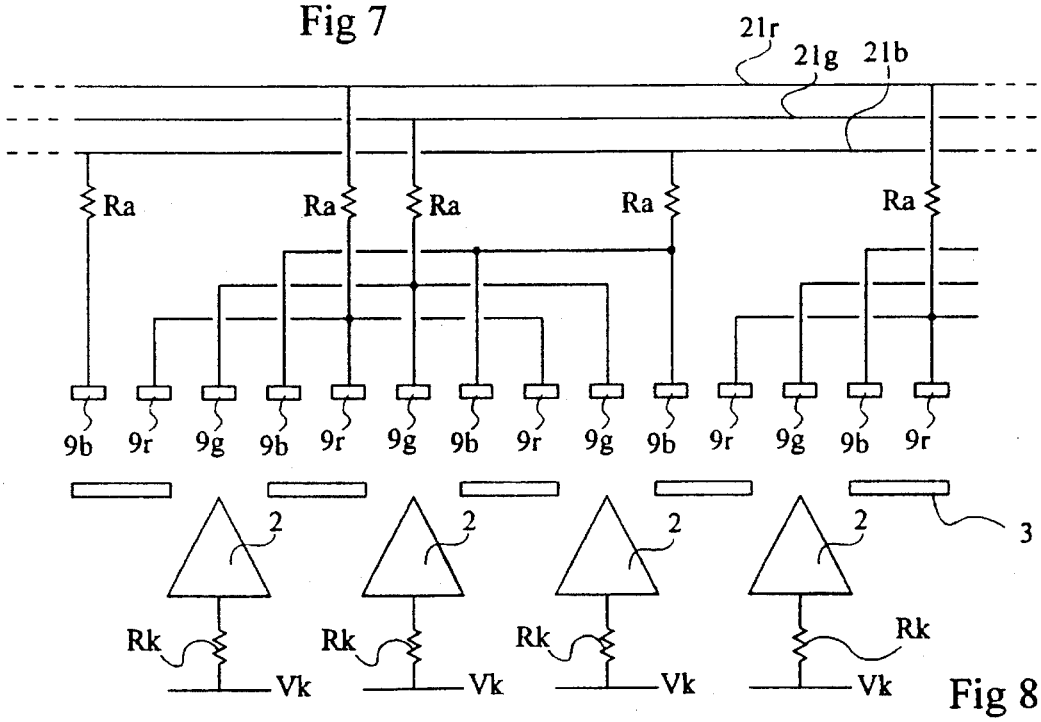
FIG. 8 represents an equivalent circuit of a microtip screen with an anode according to the embodiment of FIG. 7.

FIGS. 7 and 8 illustrate another embodiment of the present invention which also facilitates the realization of thick-film resistive portions.

In this embodiment, the conductive strips 9 of the anode are no longer individually connected to an interconnection track but are connected by groups of a small number of strips of the same color.

In the represented example, the conductive strips of a same color are connected by groups of three strips to an interconnection track, through resistive portions 22.

Two interconnection tracks, for example 21*b* and 21*g*, are disposed on a same side of the anode, whereas the third track, for example 21*r*, is disposed on the opposite side of the anode. The conductive strips 9*r* are connected by groups of three consecutive strips, by their extremities disposed on the side of track 21*r*, through tracks 26*r* that are parallel with the interconnection tracks. The conductive strips 9*g* are connected by groups of three consecutive strips, by their extremities disposed on the side of track 21*g*, also through tracks 26*g* that are parallel with the interconnection tracks.

The conductive strips 9b of the third color are connected by groups of three strips, but directly through the resistive portions 22b.

As above, an insulation layer 23 is preferably disposed over the whole surface of the anode. Layer 23 is etched away, in front of strips 9 in the useful surface of the screen accommodating the phosphor elements, and outside the useful surface of the screen to realize interconnections through resistive portions 22. Apertures 25r, 25g and 25b are formed in the insulation layer 23 in front of one of the extremities of the resistive portions 22r, 22g and 22b, in front of the interconnection tracks 21r, 21g and 21b, respectively. Apertures 24r and 24g are formed in front of the other extremity of the resistive portions 22r and 22g, in front of tracks 26r and 26g, respectively. Apertures 24b are formed in front of the extremity of each conductive strip 9b that is near the interconnection track 21b.

Preferably, at least each strip 9b of the third color has, at its extremity disposed on the side of track 21b, a pad 27 in front of which an aperture 24b is formed. Aperture 24b permits to easily connect the strips 9b by groups of three strips, through the same resistive portion 22b, to the interconnection track 21b.

Thus, as illustrated in FIG. 8, each group of three strips of a same color is individually connected, through a resistor Ra, to an interconnection track of strips of a same color.

However, the number of conductive strips for each group should not be too high so that each resistor Ra can be high enough without causing the anode-cathode voltage to drop by more than a low percentage.

The selection of one of the disclosed embodiments depends, for example, upon the width of the anode conductive strips, therefore upon the size of the screen pixels. Actually, the more the pixel size is decreased, the narrower the conductive strips 9 and the more the serigraphy accuracy of the thick-film resistive portions is critical.

By way of example, for a pixel of 300 μm in side, the selected embodiment will be that of FIG. 3 with resistive portions 22 of 75 μm in width, the pitch between the anode conductive strips being 100 μm.

As is apparent to those skilled in the art, various modifications can be made to the above disclosed preferred embodiments. More particularly, each described element of the layers constituting the anode can be replaced with one or more constituting elements providing the same function.

Furthermore, although the above description is made with reference to a color screen, the invention can be applied to a monochrome screen including parallel strips of phosphor elements.

We claim:

1. An anode for a flat display screen, of the type including at least one set (*r, g, b*) of phosphor strips (7) disposed over corresponding conductive strips (9) and at least one interconnection conductor (21) for said phosphor strips, wherein said conductive strips (9) of said set are interconnected through resistors (22) disposed in series between the conductive strips and the associated interconnection conductor.

2. The anode of claim 1, wherein each conductive strip (9) is individually connected to said interconnection conductor (21) through a resistor (22).

3. The anode of claim 1, wherein a single resistor (22) is associated with a plurality of conductive strips (9) of said set.

4. The anode of claim 1, wherein the resistors are serigraphied thick-film resistive portions (22) formed over an insulation layer (23) deposited at least over one track (21) constituting said interconnection conductor, said insulation layer (23) being locally etched away (25; 24) in front of the extremities of each resistive portion to allow the electrical connection of said extremities, respectively to an extremity of at least one conductive strip (9) and to the interconnection track (21).

5. The anode of claim 4, wherein the insulation layer (23) extends over the whole surface of the anode and is etched away, in the useful surface of the screen, in front of each conductive strip (9).

6. The anode of claim 4, wherein all the resistive portions (22) associated with said interconnection track (21) have the same length.

7. The anode of claim 1, including three sets (*r, g, b*) of alternate phosphor strips (9r, 9g, 9b), each corresponding to a color, and at least three conductors (21r, 21g, 21b) interconnecting the strips of a same color.

8. The anode of claim 7, wherein all the resistive portions (22r, 22g, 22b) associated with a same interconnection track (21r, 21g, 21b) have the same length and extend from an extremity of a conductive strip (9r, 9g, 9b) to the associated track.

9. The anode of claim 7, wherein all the interconnection tracks (21r, 21g, 21b) are parallel and on the same side of the anode, perpendicularly to the conductive strips (9r, 9g, 9b).

10. The anode of claim 8, wherein at least two interconnection tracks (21r, 21g, 21b), perpendicular to the conductive strips (9r, 9g, 9b), are on opposite sides of said conductive strips.

* * * * *